United States Patent [19]

Kao et al.

[11] 3,964,522

[45] June 22, 1976

[54] BEVEL PIPE WINDER

[75] Inventors: Paul W. Kao, Covina; Homer C. Lamborn, Glendora, both of Calif.

[73] Assignee: United States Pipe and Foundry Company, Birmingham, Ala.

[22] Filed: Sept. 20, 1971

[21] Appl. No.: 181,824

[52] U.S. Cl. ..... 242/7.22; 138/176; 156/446

[51] Int. Cl.[2] ..... B65H 1/00

[58] Field of Search ..... 138/176; 338/174; 242/7.21, 7.22, 7.23, 7.16; 156/425, 429, 446

[56] References Cited

UNITED STATES PATENTS

| | | | |
|---|---|---|---|
| 2,011,463 | 8/1935 | Yianini | 138/176 UX |
| 2,101,441 | 12/1937 | Marsten | 338/174 X |
| 3,052,419 | 9/1962 | Huck | 138/176 X |
| 3,724,768 | 4/1973 | Breitfuss et al. | 242/7.22 X |

*Primary Examiner*—William Price
*Assistant Examiner*—Steven M. Polland
*Attorney, Agent, or Firm*—Lyon & Lyon

[57] ABSTRACT

In the manufacture of prestressed concrete pipe, wire is wound under tension around the concrete body of the pipe and secured thereto. In accomplishing this the concrete pipe is mounted on a turntable for rotaton about the longitudinal axis of the pipe and wire under tension is wrapped thereon in a helical fashion from one end to the other.

3 Claims, 3 Drawing Figures

INVENTORS.
PAUL W. KAO
HOMER C. LAMBORN
BY
Lyon & Lyon
ATTORNEYS

INVENTORS.
PAUL W. KAO
HOMER C. LAMBORN
BY
Lyon & Lyon
ATTORNEYS

BEVEL PIPE WINDER

There is disclosed herein apparatus and methods particularly useful for winding prestressed concrete pipe having a beveled end. Wire is similarly wrapped on the pipe in a helical fashion but with a constant spacing between the turns of wire on the long side of the pipe and a different, but constant, spacing on the short side of the pipe. The wire is fed to the periphery of the pipe by a wire sheave, and a controlled and movable roller means functions to displace the wire periodically to achieve a helical winding of different spacing as noted. The sheave assembly is moved by means of a leadscrew. A cam follower synchronized in movement with the leadscrew and cooperating with a cam rotated in synchronism with the pipe body, is used to control an electro-hydraulic system. This latter system in turn controls the variable movement of the roller which displaces the wire being fed onto the periphery of the pipe body. Control means are provided in the system for enabling the apparatus to properly bevel-wind pipes of different lengths, and pipes having different bevel angles, without requiring a change of cam or cam shape, and also allows wrapping of non-bevel end pipe.

This invention relates to apparatus and methods for wrapping prestressed concrete pipe and the like, and more particularly to apparatus and methods for winding under tension on pipe of this nature having a beveled end.

Prestressed concrete pipe is well known and typically includes a cylindrical core or pipe body of high quality concrete with a water-tight membrane of light gage metal cylinder embedded therein. High tensile strength stressing wire is wound on the periphery of the core, and the ends of the wire are securely anchored at the respective ends of the pipe. The wire is continuously wound on the concrete at a very high tensile stress, and the pipe cores frequently are relatively large, such as in lengths from eight to twenty-four feet and of various diameters. After the wire is wrapped and anchored, a concrete encasement is applied over the wire and core.

In certain applications it is necessary to manufacture prestressed concrete pipe having one end beveled; that is, one end inclined or angled with respect to a plane perpendicular to the longitudinal axis of the pipe. One method of manufacturing a bevel pipe is to join a normal prestressed concrete pipe and a non-prestressed, but structurally adequate, steel pipe section in order to provide a single piece of pipe with a beveled end. This is accomplished by wrapping the pipe body with wire by wire feed apparatus which advances longitudinally along the pipe body under control of a leadscrew, at a uniform rate, while the pipe body is rotated to thereby provide uniform helical winding on the straight portion of the pipe body. The helical winding continues along the pipe body over the short section of the heavy steel pipe and is terminated at a point at the short side of the pipe and substantially at right angles to the longitudinal axis of the pipe such that the helical winding does not extend onto the upper remaining beveled end of the pipe. Another approach is described in U.S. Pat. Nos. 3,052,266 and 3,052,419, in which a concrete pipe body having an upper beveled end is wrapped. This approach involves helically wrapping the lower, non-beveled end, portion of the pipe at a conventional uniform rate, and then wrapping the upper, beveled end, portion of the pipe at a different uniform rate by means of a controlled pivotally mounted wire feed arm. This results in the upper wrapping having a constant ratio between the pitches of the wrappings on the short and the long side of the pipe. Therefore, the starting point of the upper wrapping varies with different pipe lengths and for different bevel angles. This requires that a point be determined, and marked, along each pipe body where the change in pitch is to occure.

The present invention is an advance over the aforementioned techniques wherein the uniform spacing throughout the entire length according to the present concepts induces a much more uniform stress throughout the entire length of the pipe rather than having a different pitch wire spacing concentrated at the bevel end of the pipe. The present invention involves apparatus which enables relatively flexible operation in wrapping pipe, and the like, of different lengths and with different bevel angles which can be defined in terms of bevel ratio (bevel offset in inches divided by pipe length in feet or inches). A helical wrapping is provided having a constant pitch on the long side of the pipe and a different, but constant, pitch on the short side of the pipe, the ratio of the pitches varying for different length pipes and different bevel angles. Additionally, wrapping of different length pipes and pipes with different bevel angles, as well as non-bevel end pipe, can be accomplished relatively simply using the bevel ratio control potentiometer and without selecting and marking any change point according to the present invention, and without requiring the complex or time-consuming adjustments of the apparatus or system.

Accordingly, it is a principal object of the present invention to provide novel bevel pipe winding and the apparatus for accomplishing the same.

Another object of this invention is to provide a novel method of applying a bevel winding in the manufacture of prestressed concrete pipe.

An additional object of this invention is to provide improved apparatus for applying a helical winding to bevel end pipe, and which readily accommodates such pipe of different lengths and with different bevel angles.

These and other objects and features of the present invention will become better understood through a consideration of the following description taken in conjunction with the drawings in which.

Figure 1:
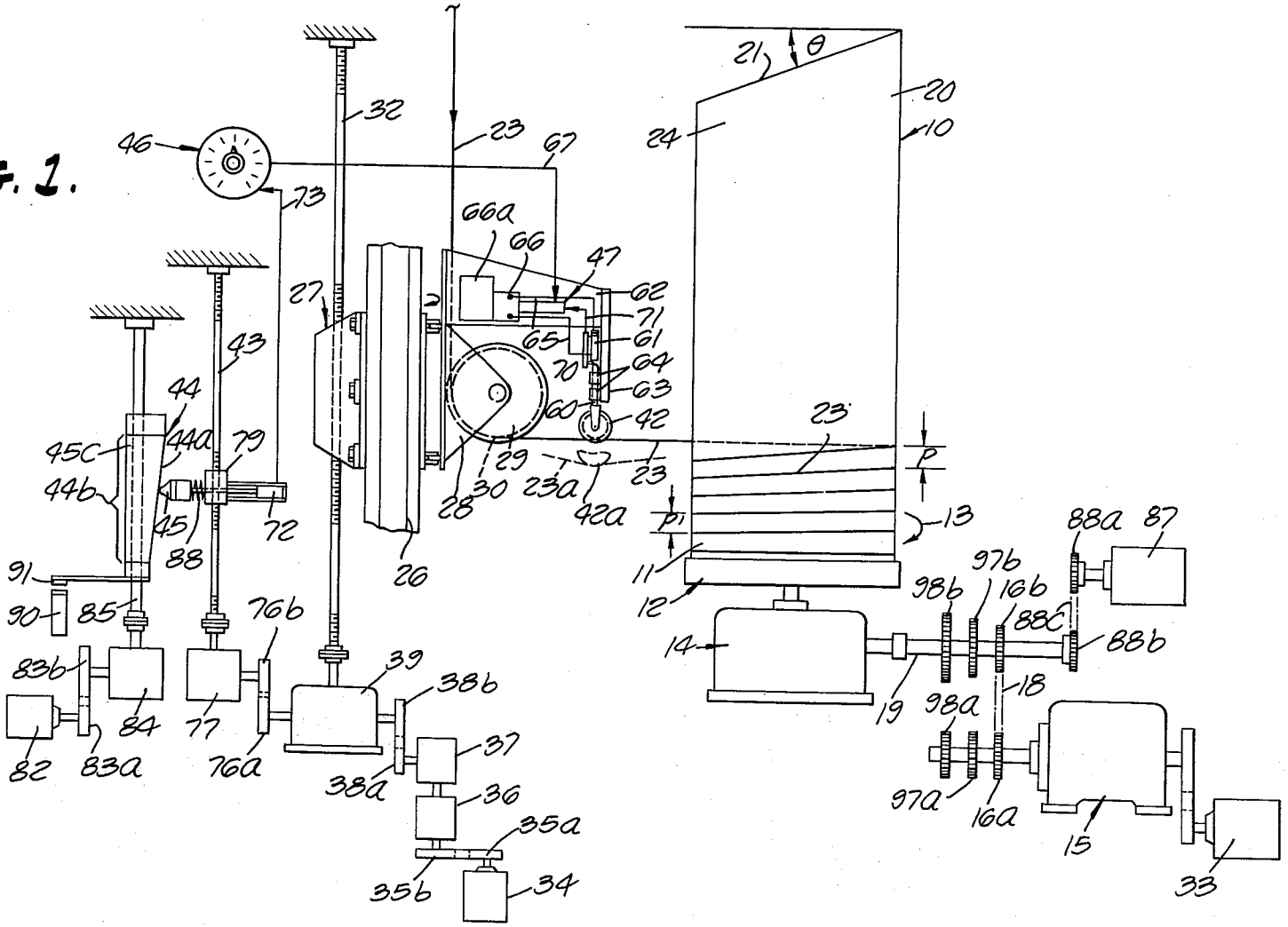
FIG. 1 illustrates exemplary bevel pipe winding apparatus according to the present invention.

Turning now to FIG. 1, a concrete pipe body 10 is diagramatically illustrated having a lower end 11 mounted on a turntable 12 which is rotated in the direction of an arrow 13. The turntable 12 is rotated through a right angle reducer 14 which is driven by a motor 15 through sprockets 16a-16b, a chain 18 and a shaft 19, it being appreciated that any suitable driving arrangement may be employed. The upper end 20 of the pipe 10 is beveled at 21 at a bevel angle indicated as 0. As is known to those skilled in the art, were the pipe 10 not beveled at 21, the same would be wrapped with a helical wrapping of wire 23 of constant pitch throughout the length of the pipe up to approximately a point indicated at 24. However, with the upper bevel end 20, suitable wrapping is necessary above the point 24 to provide structural strength, unless a separate heavy metal bevel end is used as noted previously.

Conventionally, in wrapping a pipe 10 with the wire 23, suitable apparatus is provided for feeding or paying-out the wire 23 under tension onto the periphery of the pipe body 10. Such apparatus includes a suitably supported fixed column 26 having a carriage 27 mounted thereon for movement up and down the column 26. A sheave mounting bracket 28 is pivotally mounted to the carriage 27, and has a peripherally grooved sheave 29 rotatably mounted thereon. The wire 23 is maintained in tension, such as 166,500 psi for Type II No. 6 gage wire, and is fed around the sheave 29 at 30 and onto the periphery of the pipe body 10. For illustrative purposes it shall be assumed that the pipe is wrapped from the bottom upwards. However, the pipe also may be wrapped from the top down or wrapped horizontally. The initial or beginning end of the wire is suitably secured at the commencement of the wrap at the lower end 11 of the pipe body 10 by suitable means (not shown), such as by a conventional anchor block assembly.

The carriage 27 is driven up the column 26 by a pitch control main leadscrew 32 which is driven in any suitable manner in synchronism with rotation of the pipe body 10. An exemplary arrangement includes the use of a syncro system employing a transmitter 33 directly geared to the pipe motor 15 and a receiver 34 electrically connected with the transmitter 33 in a conventional manner to synchronize 34 with 33. The receiver 34 drives the leadscrew 32 through suitable gears 35*a*–35*b*, a transmission 36, a variable speed drive 37, gears 38*a*–38*b*, and a right angle reducer 39.

The apparatus in FIG. 1 thus far described is essentially conventional for wrapping a non-bevel pipe body with a uniform helical winding of wire 23. The apparatus, however, further includes certain means which will be described subsequently for enabling the objectives and benefits of the present invention to be realized. Very briefly, these additional means include a controllable roller 42 for displacing the wire 23 as it is applied to the pipe body 10, leadscrew 43, cam 44, cam follower 45, bevel ratio control 46, and control system 47 which controls the movement of the roller 42. Before embarking on a detailed description of the latter devices, reference should be made to FIG. 2 which illustrates diagramatically the manner in which bevel pipe is wound according to the concepts of the present invention.

Figure 2:
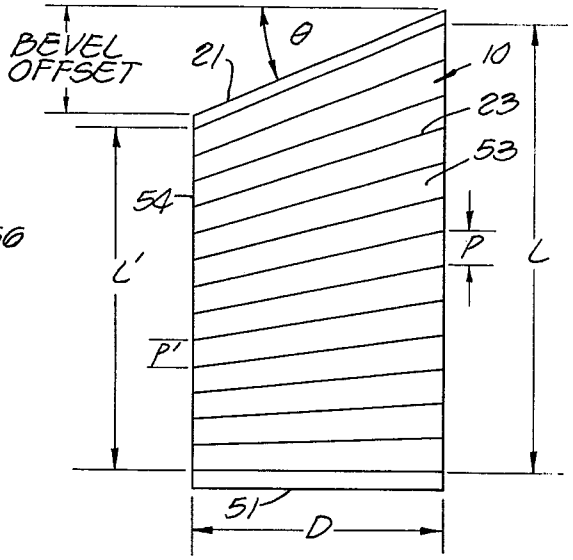
FIG. 2 is a diagram illustrating the manner in which beveled pipe is wound according to the present invention.

FIG. 2 illustrates a pipe body 10 having a lower end 51 in a plane normal to the longitudinal axis of the pipe and an upper end 21 inclined or beveled with respect to a plane normal to the longitudinal axis of the pipe. The pipe has a long side 53 and a short side 54 because of the inclination of the beveled end 21. As to certain of the designations in FIG. 2, the outside diameter of the pipe core or body 10 is D; 0 is the bevel angle of the end 21; L is the length of that portion on the long side 53 wrapped with wire 23 and may be termed the long side wire wrap length; L′ is a similar length for the short side 54; P is the wire spacing at the long side 53 of the pipe; and P′ is the wire spacing at the short side 54. The "bevel offset" indicated in FIG. 2 is equal to $D \times \tan \theta$. According to the present concepts P is greater than P′. The number of wraps of prestressed wire on the pipe body 10 is equal to $L/P = L'/P'$. The "bevel ratio" is equal to the bevel offset divided by total pipe length of the long side 53. As will appear later, these relationships are useful in setting the apparatus for wrapping various lengths of pipe and pipes having different bevel angles $\theta$.

Turning again to FIG. 1 and to the roller 42 and control thereof, this roller is mounted on an end 60 of the piston rod of a hydraulic ram or cylinder 61. The hydraulic cylinder is mounted on a bracket arm 62 attached to the mounting bracket 28, and a depending leg 63 has coupled therewith journals 64 through which a connecting rod with which the piston rod 60 is connected extends. The hydraulic cylinder 61 is a double acting hydraulic cylinder, and is hydraulically coupled by lines 65 with an electro-hydraulic servo valve 66. The control circuit 47 is electrically connected by lines indicated diagramatically at 67 with the servo valve 66. A feedback transducer 70 is coupled with the hydraulic assembly to sense the position of the roller 42 and provide an electrical feedback signal by a line 71 to the control circuit 47 to ensure accuracy in operation of the system and as will become apparent. An electrical signal from a pickup inductive rectilinear transducer 72, which signal is a function of the position of the cam follower 45 as dictated by the cam 44, is applied by a line 73 to the bevel ratio control 46 which may be a ratio control potentiometer, all as will be described subsequently.

Turning now to the manner in which the pickup, or programmer, transducer 72 derives an appropriate signal, the programmer follower leadscrew 43 is driven in synchronism with the main leadscrew 32 through gears 76*a*–76*b* and a right angle reducer 77. A nut and transducer mounting bracket, or carriage, 79 is mounted to ride along the leadscrew 43. The cam follower 45 is normally biased by a compression spring 80 toward the surface of the cam 44.

The cam 44 is driven from a selsyn motor receiver 82 through gears 83*a*–83*b*, a right angle reducer 84 and a shaft 85. The motor receiver 82 is electrically coupled to, and thus synchronized with, a selsyn motor transmitter 87 connected by sprockets 88*a*–88*b* and a chain 88*c* to drive shaft 19. In this manner, the cam 44 is rotated in synchronism with the rotation of the pipe body 10. There may be associated with the cam 44 a magnetic reed switch 90 which is actuated from an arm carrying a magnet 91. The reed switch 90 will be actuated on each revolution of the cam 44, and the output of the switch may be used to provide a cam position indication.

Before embarking on a detailed description of the operation of the present apparatus for different length pipes and for different bevel angles, a brief description of the operation thereof at this point may be helpful. Basically, the turntable 12 and carriage 27 are operated to cause the wire 23 to be helically wound upon the pipe core 10. As the wire 23 is fed toward the short side (54) of the pipe, the hydraulic ram 61 causes the roller 42 to displace the wire 23, such as indicated in dashed lines at 42*a* and 23*a*, so as to maintain a constant pitch of the wrap on the short side of the pipe. The action is controlled by the control circuit 47, control 46 and the cam 44.

Each successive wrap on the short side of the pipe requires a progressively increasing stroke of the hydraulic ram 61, with the greatest stroke occurring at the top of the pipe; whereas, the roller 42 is in its normal position as shown in full lines in FIG. 1 during wrapping of the long side (53) of the pipe body 10. This action provides a constant pitch wrap on the long side and a different, but constant, pitch wrap on the short side. The amount of displacement of the roller 42, and thus displacement or deviation of the wire 23 toward the short end of the pipe, is different for different length pipes and different bevel angles; however, the latter are readily accommodated by appropriate setting of the control 46 which can be calibrated to thereby greatly simplify set-up and operation of the apparatus in wrapping various length pipes and with different bevel angles.

The signal from the cam follower transducer 72 is applied to the control 46 which may be a potentiometer, and the setting of this control sets the amount of the transducer signal from transducer 72 to be applied to the control circuit 47. With relatively long pipe a small portion of the signal from the input transducer 72 is applied by the control 46 to the circuit 47; whereas, with relatively short pipe, a larger amount of this signal is applied by the control 46. On the other hand, large bevel offsets involve the application by the control 46 of a larger portion of the signal from the transducer 72 than do small bevel offsets. Substantial simplification in operation can be achieved by using the bevel ratio which is the bevel offset in inches divided by long side pipe length in feet or inches. Then, with a large bevel ratio, a greater portion of the transducer signal is used to cause greater displacement of the roller 42 than when a smaller bevel ratio is involved.

Turning now to a more detailed discussion of certain of the operational and structural criteria, the rotational speed of the cam 44 and the turntable 12 are equal and are synchronized. The amount of the rise on the cam provided by cam face 44a (which also is the total displacement of the cam follower 45 and the input transducer 72) may be, in an exemplary embodiment, approximately 2 inches with a cam length at **44*b* approximately 10 inches. Only one cam is required for various lengths of pipes and different bevel offsets, such as pipe lengths of 8 feet through 24 feet, and for bevel offsets from one inch through 10 inches inasmuch as the bevel ratio control 46 allows adjustment for accommodating such variables. The leadscrew 43 is driven from the drive for the leadscrew 32, and thus is synchronized therewith. The rotational speed of the leadscrew 43 is, of course, slower than that of the main leadscrew 32** inasmuch as the linear travel required is substantially shorter. In the exemplary apparatus, this travel ratio is aproximately 1 to 26.

A manual override (not shown) can be provided for the driving arrangement of the cam 44 to allow the cam position to be adjusted to coincide with the orientation of the pipe body 10. That is, when the straight side **44*c* of the cam 44 is in contact with the cam follower 45, the wire 23 should be tangent to the long side (53) of the pipe body 10 or, alternatively, the sloped side 44*a* be similarly aligned with respect to the short side (54) of the pipe body. That is, the cam follower 45 is in the same position with respect to the face of the cam 44 as the wire 23 is with respect to the periphery of the pipe body 10. When it is desired to wrap a straight, or non-bevel pipe, it is merely necessary to set the bevel ratio control 46** to zero.

Turning again to the bevel ratio control 46, the same may be calibrated in accordance with the following Table I so as to accommodate pipe lengths from approximately 8 feet to 24 feet, and bevel offsets of approximately 1 through 10 inches.

TABLE I

| Nom Pipe Length (L) | Bevel Offset | Bevel Ratio | % of Maximum Calibration of Control 46 | Bevel-Ratio Control Setting 46 Inch of Bevel Offset per Pipe Length Feet |
|---|---|---|---|---|
| 8'=96" | 10" | .1042 | 100 | 1.250 |
| | 9 | .0938 | 90.01 | 1.125 |
| | 8 | .0833 | 79.94 | 1.000 |
| | 7 | .0729 | 69.96 | .875 |
| | 6 | .0625 | 59.98 | .750 |
| | 5 | .0521 | 50 | .625 |
| | 4 | .0417 | 40.02 | .500 |
| | 3 | .0313 | 30.04 | .375 |
| | 2 | .0208 | 19.96 | .250 |
| | 1 | .0104 | 9.98 | .125 |
| 16'=192" | 10 | .0521 | 50 | .625 |
| | 9 | .0469 | 45.01 | .5625 |
| | 8 | .0417 | 40.02 | .500 |
| | 7 | .0365 | 35.03 | .4375 |
| | 6 | .0313 | 30.04 | .375 |
| | 5 | .0260 | 24.95 | .3125 |
| | 4 | .0208 | 19.96 | .250 |
| | 3 | .0156 | 14.97 | .1875 |
| | 2 | .0104 | 9.98 | .125 |
| | 1 | .0052 | 4.99 | .0625 |
| 24'=288" | 10 | .0347 | 33.30 | .4166 |
| | 9 | .0313 | 30.04 | .375 |
| | 8 | .0278 | 26.68 | .333 |
| | 7 | .0243 | 23.32 | .2917 |
| | 6 | .0208 | 19.96 | .250 |
| | 5 | .0174 | 16.70 | .208 |
| | 4 | .0139 | 13.34 | .167 |
| | 3 | .0104 | 9.98 | .125 |
| | 2 | .0069 | 6.62 | .083 |
| | 1 | .0035 | 3.36 | .0417 |

It can be seen from the above table that a pipe 10 having a length of 24 feet and a bevel ratio of 0.0347 involves a control 46 setting of 0.4166. The particular setting for a given bevel pipe may be determined as follows. Assume a pipe length L of twenty-four feet (288 inches), inside diameter of 96 inches, core wall thickness of 8 inches, outside diameter D of 112 inches, a bevel angle $\theta$ of 5° maximum, and a desired wire spacing on the long side (53) having a pitch of ⅝ inch (0.625), center to center. Then, the approximate number of wraps of wire 23 are:

$$24 \times 12/0.625 = 460.$$

$$\text{Bevel offset} = D \times \tan\theta = 112 \times \tan 5° = 9.8''$$

$$\text{Pipe length at the short side (54)} = 288'' - 9.8'' = 278.2''$$

$$\text{The wire spacing on the short side (54)} = 278.2/460 = 0.605'' = P'.$$

$$\text{Thus, the bevel ratio} = 9.8/24 \times 12 = 9.8/288 = 0.0347.$$

Accordingly, the setting of the bevel ratio control 46, from Table I, is 0.4166 which is 33.3% of maximum.

The pipe drive motor 15 preferably is a D.C. variable speed motor, such as a 150 horse power motor. Additional sprockets **97*a*–97*b* and 98*a*–98*b* are provided for enabling the turntable 12 to be driven at different speeds. The variable speed transmission 37 is adjustable to allow the pitch of the wrap to be varied, such as from one-half inch to one-and-one-half inch. Inasmuch as the leadscrew 43 is driven by the drive for the main leadscrew 32, both of these leadscrews operate in synchronism. The positive mechanical tie between the leadscrews 32 and 43 maintains the cam follower 45 in a proper longitudinal or axial relationship with respect to the cam 44; whereas, the electrically synchronized tie provided by transmitter 87 and receiver 82 properly synchronizes the rotation of the cam 44 with the rotation of the pipe body 10. Typical wire tensions for the wire 23 are, for example, 158,250 psi for one-fourth inch diameter wire, 166,500 psi for six gage wire, and 150,750 psi for 5/16 inch diameter wire. The force exerted by the hydraulic ram 61 varies, for example, up to approximately 3000 pounds. Typically, the wire wrapping is started at the lower end 11 of the pipe body 10** irrespective of the bevel angle.

Figure 3:
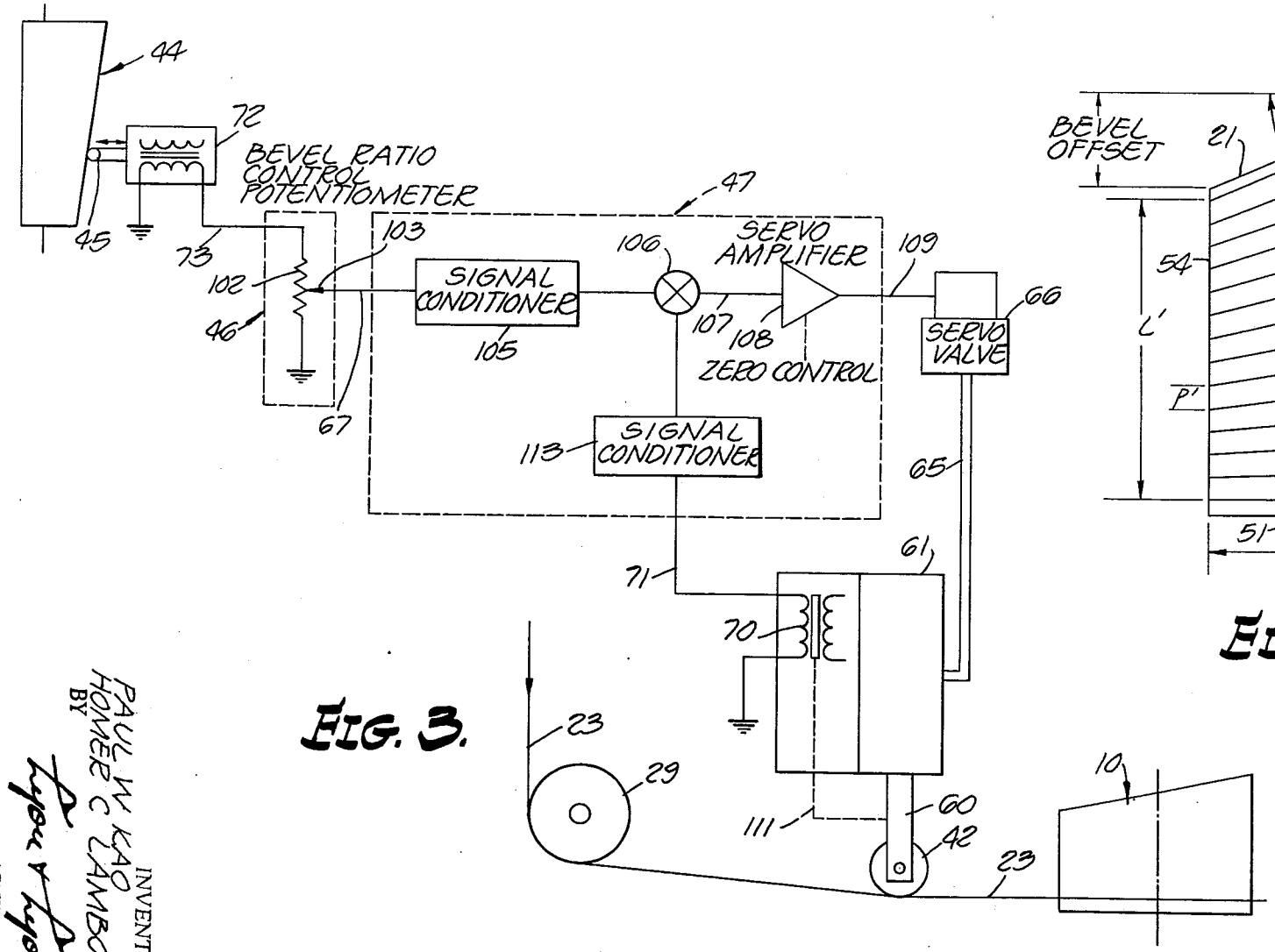
FIG. 3 illustrates an exemplary control system for the apparatus of FIG. 1.

FIG. 3 illustrates an exemplary control system for use with the apparatus of FIG. 1. Components similar to those of FIG. 1 are identified with the same reference numerals. Thus, the motion of the follower 45, caused by following the surface of the rotating cam 44, is converted to an electrical signal by the inductive rectilinear transducer 72. This may be a linear variable differential transformer, which in turn provides a signal on a line 73 to a potentiometer 102 constituting the bevel ratio control 46. A movable tap 103 of the potentiometer 102 is connected by a line 67 to a signal conditioning circuit 105 in a control circuit 47. The control circuit 47 may be a Servo amplifier Model 239 from De Mott Electronics, Inc., City of Industry, California. The signal conditioner 105 which may be a demodulator, the output of which is connected to a summing junction 106. The output of 106 is connected by a line 107 to an input of a servo amplifier 108, the output of which is connected by a line 109 to the servo valve 66. The hydraulic lines of the servo valve 66 to the hydraulic ram 61 are diagrammatically illustrated at 65. The position of the piston rod 60, and thus the roller 42, is mechanically sensed by means of a connection 111 to the feedback transducer 70 which likewise may be a linear variable differential transformer. The signal from this transducer is applied by a line 71 to a signal conditioner 113 in the circuit 47, the output of which also is applied to 106 as a feedback signal to the servo amplifier in a conventional manner. It will be apparent that the magnitude of the signal from the movable tap 103 of the potentiometer 102 determines the magnitude of the movement of the rod 60 of the hydraulic ram 61. By calibrating the control 46 as described earlier, various lengths of pipes and various bevel angles can be readily accommodated through different settings of the tap 103 of the potentiometer 102.

Further details of an exemplary embodiment are as follows. The right angle reducer 14 may have a ratio of 16.716:1; the sprockets 16*a – b* each have 37 teeth, as do the sprockets 97*a* and 98*a;* the sprockets 97*b* and 98*b* respectively have 57 and 74 teeth; the receiver 34 is a 3 horsepower syncrotie receiver; the gears 35*a*–35*b* respectively have 24 and 40 teeth; the transmission 36 may be a 4-speed transmission; and the variable drive 37 may be a Linkbelt P.I.V., size V-3-50 unit having a 5:1 ratio (2.24:1 up and 2.24:1 down) to allow appropriate drive of the carriage 27 upwardly in wrapping the pipe 10, and return of the carriage downward after the wrapping has been completed. The gears 38*a*–38*b* may be respectively 20 and 24 teeth, and the right angle drive 39 may be a reducer having a 7.6:1 ratio. The gears 76*a*–76*b* may respectively have 16 and 21 teeth, and the drive 77 be a reducer with a 50:1 ratio. The main leadscrew 32 may have a ⅓ inch pitch ⅔ lead and right hand thread, and the leadscrew 43 be a ⅝ inch, 5 thread per inch and 0.2 inch lead, right hand thread screw. The motor receiver 82 may be 1/10 horsepower and, as noted earlier, is synchronized with the transmitter 87. The receiver 82 is capable of being manually jogged to allow alignment of the cam face and cam follower. The gears 83*a*–83*b* may respectively have 35 and 39 teeth, and the drive 84 may be a reducer having a ratio of 15:1.

The present embodiments of this invention are to be considered in all respects as illustrative and not restrictive, the scope of the invention being indicated by the appended claims rather than by the foregoing description, and all changes which come within the meaning and range of equivalency of the claims therefore are intended to be embraced therein.

What is claimed is:

1. Apparatus for applying wire under tension to the periphery of a concrete body having a beveled end in the manufacture of concrete pipe or the like comprising rotatable means for supporting and rotating a concrete pipe body substantially about the axis of said body, carriage means for supplying wire under tension to the periphery of said pipe body to form a generally helical wrapping thereon, said carriage means including leadscrew means coupled with a carriage for driving the carriage substantially parallel to the axis of said body in supplying said wire to the periphery of said body, displacement means on said carriage means for causing a controlled periodic deviation of said wire as it is applied to said pipe body from one end to the other thereof to provide a helical wrapping having a uniform spacing along the entire length of a first side of said body and a different but uniform spacing along the entire length of a second side of said body substantially one hundred and eighty degrees from the first side, cam means for supplying signals to affect the operation of said displacement means, said cam means including cam and cam follower means synchronized in operation with the rotation of said pipe body and movement of said carriage means, said cam and cam follower means including a cam rotated in synchronism with the rotation of said pipe body, and including a cam follower engaging the periphery of said cam and moved with respect to the cam by second leadscrew means operated in synchronism with said leadscrew means, said cam follower including a transducer for supplying said signals to affect the operation of said displacement means, and control means responsive to the signals from said cam means for controlling the operation of said displacement means in causing said controlled deviation of said wire, said control means including selector means for selecting portions of said signals and for applying control signals to said displacement means for controlling the magnitude of said deviation of wire as it is applied to said pipe body.

2. Apparatus as in claim 1 wherein said transducer includes an electro-mechanical transducer providing electrical signals, and said selector means includes a potentiometer for selecting the level of said electrical signals to provide said helical wrapping of pipe bodies of different lengths.

3. Apparatus as in claim 1 wherein said transducer includes an electro-mechanical transducer providing electrical signals, and said selector means includes a potentiometer for selecting the level of said electrical signals to provide helical wrapping of pipe bodies having beveled ends of different angles.

* * * * *